US005124124A

United States Patent [19]

Ohashi et al.

[11] Patent Number: 5,124,124

[45] Date of Patent: Jun. 23, 1992

[54] HIGH-TENSILE COPPER ALLOY FOR CURRENT CONDUCTION HAVING SUPERIOR FLEXIBILITY

[75] Inventors: Yasusuke Ohashi; Tamotsu Nishijima; Toshihiro Fujino; Yasuhito Taki, all of Shizuoka, Japan

[73] Assignee: Yazaki Corporation, Tokyo, Japan

[21] Appl. No.: 704,247

[22] Filed: May 22, 1991

[30] Foreign Application Priority Data

May 23, 1990 [JP] Japan ..... 2-133572

[51] Int. Cl.[5] ..... C22C 9/00

[52] U.S. Cl. ..... 420/473; 148/433; 420/476

[58] Field of Search ..... 420/473, 476; 148/433

[56] References Cited

U.S. PATENT DOCUMENTS 3,977,869 8/1976 Steine et al. ..... 228/263

FOREIGN PATENT DOCUMENTS 1106967 5/1961 Fed. Rep. of Germany .

0009144 1/1984 Japan ..... 420/473

459521 3/1975 U.S.S.R. .

*Primary Examiner*—Upendra Roy

*Attorney, Agent, or Firm*—Sughrue, Mion, Zinn, Macpeak & Seas

[57] ABSTRACT

A high-tensile copper alloy for current conduction and having superior flexibility is disclosed. The high-tensile copper alloy, in a first embodiment, is consisting essentially of: from 2.0 to 4.0% by weight of Ni; from 0.4 to 1.0% by weight of Si; from 0.05 to 0.3% by weight of In; from 0.05 to 0.3% by weight of Sn; and the balance of Cu. The high-tensile copper alloy, in a second embodiment, is consisting essentially of: from 2.0 to 4.0% by weight of Ni; from 0.4 to 1.0% by weight of Si; from 0.05 to 0.3% by weight of In; from 0.01 to 0.2% by weight of Co; and the balance of Cu. The high-tensile copper alloy, in a third embodiment, is consisting essentially of: from 2.0 to 4.0% by weight of Ni; from 0.4 to 1.0% by weight of Si; from 0.05 to 0.3% by weight of In; from 0.01 to 0.3% by weight of Mg; and the balance of Cu. The high-tensile copper alloy, in a fourth embodiment, is consisting essentially of: from 2.0 to 4.0% by weight of Ni; from 0.4 to 1.0% by weight of Si; from 0.05 to 0.25% by weight of In; from 0.05 to 0.25% by weight of Sn; from 0.05 to 0.20% by weight of Mg; and the balance of Cu. The high-tensile copper alloy, in the fifth embodiment is consisting essentially of: from 2.0 to 4.0% by weight of Ni; from 0.4 to 1.0% by weight of Si; from 0.05 to 0.25% by weight of In; from 0.05 to 0.20% by weight of Co; from 0.05 to 0.20% by weight of Mg; and the balance of Cu.

2 Claims, 1 Drawing Sheet

HIGH-TENSILE COPPER ALLOY FOR CURRENT CONDUCTION HAVING SUPERIOR FLEXIBILITY

FIELD OF THE INVENTION

The present invention relates to a copper alloy, and particularly relates to a high-tensile copper alloy for current conduction having superior flexibility, in which when it is used, for example, as electric wire conductors of cars or the like, large reduction of conductivity is not generated, it is high in strength against mechanical shocks, disconnection due to tension and bending at a solderless contact terminal portion is reduced, and it is light in weight.

BACKGROUND OF THE INVENTION

Generally, cars are briefly classified into manual transmission cars and automatic transmission cars. As conductors for electric wires of such cars, mainly annealed copper wires have been used. Recently, as automatic transmission cars become popular, it has been intended to change carburetors into electronic fuel injection systems, and it has been intended to make mobile devices such as various kinds of measuring instruments, etc., be electronic devices. Since the mobile devices are made to be electronic devices, the number of electric and electronic wiring circuits in a car extremely increases, resulting in an increase in the space occupied by electric wires used in the car as well as an increase in weight due to the wires.

It is however desirable that the body of a car is light in weight in the viewpoint of improvement in fuel consumption. The increase in quantity of electric wires to be used is contrary to reduction in weight of the or body. In order to reduce the weight of the car body, it is strongly desired that the electric wires used for electric and electronic wiring circuits in the car are made light and the space occupied by the electric wires is made small.

Of electric wires used in a car, those having extremely fine diameters, such as lead wires, are sufficient for use in a micro-current circuit including, for example, a microcomputer. However, troubles such as separation or disconnection of connection portions of electric wires occurs while the car is running unless the electric wires have sufficient mechanical strength, because extremely large vibratory shocks are caused in running of the car. Conventionally, therefore, conductors having a diameter that is larger than the electrically required value have been used in order to ensure the sufficient mechanical strength.

In the case where electric conductors having a diameter that is larger than the electrically required value are used in order to ensure the sufficient mechanical strength, it is impossible to reduce the weight of the electric wires for use in electric and electronic wiring circuits in a car and to reduce the space occupied by the electric wires.

Hard copper wires capable of ensuring good mechanical strength even if the outer diameter of the electric conductors is made small have been examined in order to reduce the weight of the car electric wires. However, the hard copper wires have extremely low elongation because of the quality of materials thereof. Accordingly, if solderless connection is formed at terminals using the hard copper wires, the connection portions are sometimes damaged when a mechanical load due to external force such as a vibratory shock generated during the car running is applied to the connection portions. That is, if solderless connection is formed at the terminals using the hard copper wires, the terminal solderless contact portions are mechanically weak so that disconnection due to external shocks may be easily caused to thereby make the reliability poor.

Further, although it can be realized to reduce the weight of the car electric wires by making the diameter of their electric conductors small, the mechanical strength is lowered if the diameter of the electric conductors of conventional annealed copper wires is made small. Recently, therefore, a Cu-Ni-Ti alloy a Cu-Ni-Si alloy and the like, have been proposed as copper alloys that can ensure mechanical strength even if the outer diameter of the electric conductors is small, and which have relatively good repetition bending strength and conductivity.

The Cu-Ni-Ti alloy is disclosed, e.g., in JP-A-60-184655 and JP-A-61-69952, and the Cu-Ni-Si alloy is disclosed, e.g., in JP-A-63-62834, JP-A-63-130752 and JP-A-63-130739. (The term "JP-A" as used herein means an unexamined published Japanese patent application.)

In the Cu-Ni-Ti alloy, the tensile strength is improved without lowering the conductivity not so largely by making the Ni-Ti intermetallic compound precipitate into a Cu matrix. However, there is a problem that in the Cu-Ni-Ti alloy, it is still impossible to obtain the tensile strength sufficient to stand against the mechanical load due to the external force such as vibration shocks or the like generated during the car running.

Further, in the Cu-Ni-Si alloy, the tensile strength is improved without greatly lowering the conductivity by making the Ni-Si intermetallic compound precipitate into a Cu matrix. However, there is also a problem that in the Cu-Ni-Si alloy, it is still impossible to obtain the tensile strength sufficient to stand against the mechanical load due to the external force such as vibration shocks or the like generated during the car running.

SUMMARY OF THE INVENTION

It is an object of the present invention to provide a high-tensile copper alloy for current conduction and having superior flexibility, in which: not so large a reduction of conductivity is generated; it is high in strength against mechanical shocks; disconnection due to tension and bending at a solderless contact terminal is reduced; and it is capable of making wiring circuits light in weight.

Other objects and effects of the present invention will be apparent from the following description.

The present invention relates to, as a first embodiment, a high-tensile copper alloy for current conduction consisting essentially of: from 2.0 to 4.0% by weight of Ni; from 0.4 to 1.0% by weight of Si; from 0.05 to 0.3% by weight of In; from 0.05 to 0.3% by weight of Sn; and the balance of Cu.

The present invention relates to, as a second embodiment, a high-tensile copper alloy for current conduction consisting essentially of: from 2.0 to 4.0% by weight of Ni; from 0.4 to 1.0% by weight of Si; from 0.05 to 0.3% by weight of In; from 0.01 to 0.2% by weight of Co; and the balance of Cu.

The present invention relates to, as a third embodiment, a high-tensile copper alloy for current conduction consisting essentially of: from 2.0 to 4.0% by weight of Ni; from 0.4 to 1.0% by weight of Si; from 0.05 to 0.3% by weight of In; from 0.01 to 0.3% by weight of Mg; and the balance of Cu.

The present invention relates to, as a fourth embodiment, a high-tensile copper alloy for current conduction consisting essentially of: from 2.0 to 4.0% by weight of Ni; from 0.4 to 1.0% by weight of Si; from 0.05 to 0.25% by weight of In; from 0.05 to 0.25% by weight of Sn; from 0.05 to 0.20% by weight of Mg; and the balance of Cu.

The present invention relates to, as a fifth embodiment, a high-tensile copper alloy for current conduction consisting essentially of: from 2.0 to 4.0% by weight of Ni; from 0.4 to 1.0% by weight of Si; from 0.05 to 0.25% by weight of In; from 0.05 to 0.20% by weight of Co; from 0.05 to 0.20% by weight of Mg; and the balance of Cu.

BRIEFED DESCRIPTION OF THE DRAWING

FIG. 1 is a schematic view showing the bending test method in the examples of the present invention and the comparative examples.

DETAILED DESCRIPTION OF THE INVENTION

Figure 1A:
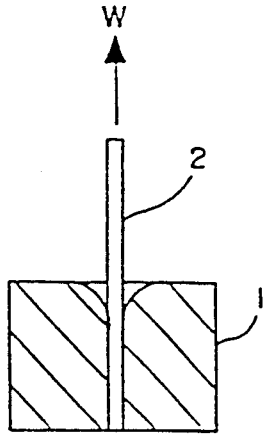

In the present invention, an intermetallic compound of Ni and Si ("Ni-Si intermetallic compound" hereinafter) is precipitated in a Cu matrix, so that the tensile strength is improved while the conductivity is not largely lowered, and further adding In as well as Sn, Co, Mg, the combination of Sn and Mg, or the combination of Co and Mg to the copper alloy, the tensile strength of the alloy is further improved.

In the present invention, the reason why the Ni content is selected to be from 2.0 to 4.0% by weight is in that if the Ni content is less than 2.0% by weight, the tensile strength is little improved by precipitating an Ni-Si intermetallic compound, while if the Ni content is more than 4.0% by weight, although the tensile strength is improved, the amount of Ni that is dissolved as a solid solution in a Cu matrix increases, so that the conductivity is remarkably spoiled and the workability is deteriorated.

In the present invention, the reason why the Si content is selected t be from 0.4 to 1.0% by weight is in that if the Si content is selected to be smaller than 0.4% by weight, the tensile strength is little improved by making the Ni-Si intermetallic compound precipitate, while if the Si content is selected to be larger than 1.0% by weight, the amount of Si that is dissolved as a solid solution in the Cu matrix is increased, so that the conductivity is lowered.

In the first through fifth embodiments of the present invention, the weight ratio of Ni to Si is preferably from 4 to 5.

In the first embodiment of the present invention, the reason why the In content is selected to be from 0.05 to 0.3% by weight is in that if the In content is selected to be smaller than 0.05% by weight, the effect of improving the tensile strength is insufficient, while if the In content is selected to be larger than 0.3% by weight, the amount of In that is dissolved as a solid solution in the Cu matrix increases to thereby remarkably lower the conductivity.

In the first embodiment of the present invention, the reason why the Sn content is selected to be from 0.05 to 0.3% by weight is in that if the Sn content is selected to be smaller than 0.05% by weight, the effect for improving the tensile strength is insufficient, while if the Sn content is selected to be larger than 0.3% by weight, the conductivity is remarkably lowered.

In the second embodiment of the present invention, the reason why the In content is selected to be from 0.05 to 0.3% by weight is in that if the In content is selected to be smaller than 0.05% by weight, the effect of improving the tensile strength is insufficient, while if the In content is selected to be larger than 0.3% by weight, the amount of In that is dissolved as a solid solution in the Cu matrix increases to thereby remarkably lower the conductivity and increase the production cost.

In the second embodiment of the present invention, the reason why the Co content is selected to be from 0.01 to 0.2% by weight is in that if the Co content is selected to be smaller than 0.01% by weight, the effect for improving the tensile strength is insufficient, while if the Co content is selected to be larger than 0.2% by weight, the conductivity is remarkably lowered and the workability and casting property are deteriorated.

In the third embodiment of the present invention, the reason why the In content is selected to be from 0.05 to 0.3% by weight is in that if the In content is selected to be smaller than 0.05% by weight, the effect of improving the tensile strength is insufficient, while if the In content is selected to be larger than 0.3% by weight, the amount of In that is dissolved as a solid solution in the Cu matrix increases to thereby remarkably lower the conductivity and increase the production cost.

In the third embodiment of the present invention, the reason why the Mg content is selected to be from 0.01 to 0.3% by weight is in that if the Mg content is selected to be smaller than 0.01% by weight, the effect for improving the tensile strength is insufficient, while if the Mg content is selected to be larger than 0.3% by weight, the conductivity is remarkably lowered and the workability and casting property are deteriorated.

In the fourth embodiment of the present invention, the reason why the In content is selected to be from 0.05 to 0.25% by weight is in that if the In content is selected to be smaller than 0.05% by weight, the effect of improving the tensile strength is insufficient, while if the In content is selected to be larger than 0.25% by weight, the amount of In that is dissolved as a solid solution in the Cu matrix increases to thereby remarkably lower the conductivity.

In the fourth embodiment of the present invention, the reason why the Sn content is selected to be from 0.05 to 0.25% by weight is in that if the Sn content is selected to be smaller than 0.05% by weight, the effect of improving the tensile strength is insufficient, while if the Sn content is selected to be larger than 0.25% by weight, the conductivity is remarkably lowered.

In the fourth embodiment of the present invention, the reason why the Mg content is selected to be from 0.05 to 0.20% by weight is in that if the Mg content is selected to be smaller than 0.05% by weight, the effect for improving the tensile strength is insufficient, while if the Mg content is selected to be larger than 0.20% by weight, the conductivity is remarkably lowered and the workability and casting property are deteriorated.

In the fifth embodiment of the present invention, the reason why the In content is selected to be from 0.05 to 0.25% by weight is in that if the In content is selected to be smaller than 0.05% by weight, the effect of improving the tensile strength is insufficient, while if the In content is selected to be larger than 0.25% by weight, the amount of In that is dissolved as a solid solution in the Cu matrix increases to thereby remarkably lower the conductivity and increase the production cost.

In the fifth embodiment of the present invention, the reason why the Co content is selected to be from 0.05 to 0.20% by weight is in that if the Co content is selected to be smaller than 0.05% by weight, the effect of improving the tensile strength is insufficient, while if the Co content is selected to be larger than 0.20% by weight, the workability is deteriorated.

In the fifth embodiment of the present invention, the reason why the Mg content is selected to be from 0.05 to 0.20% by weight is in that if the Mg content is selected to be smaller than 0.05% by weight, the effect for improving the tensile strength is insufficient, while if the Mg content is selected to be larger than 0.20% by weight, the conductivity is remarkably lowered and the workability and casting property are deteriorated.

The thus produced high-tensile copper alloy for the current conduction and having superior flexibility according to the present invention has conductivity which is improved in comparison to that of the conventional high-tensile copper alloy for current conduction, and which is about from 41 to 46% IACS.

Further, the thus produced high-tensile copper alloy for the current conduction and having superior flexibility according to the present invention shows tensile strength which is remarkably improved so as to be larger than about from 1.6 to 1.7 times of that of hard copper, and which is considerably improved in comparison with that of the conventional high-tensile copper alloy for current conduction.

Further, the thus produced high-tensile copper alloy for the current conduction and having superior flexibility according to the present invention has elongation which is larger than from five to seven times of that of hard copper while it is smaller than that of annealed copper, and shows repetition bending strength that is equivalent to or larger than that of annealed copper. Further, the elongation is not lower than that of the conventional high-tensile copper alloy for current conduction.

Because of the above reasons, in the case where the high-tensile copper alloy for the current conduction and having superior flexibility according to the present invention is used as conductors for car electric wires, the alloy shows characteristics suitable to the conductors for the car electric wires, so that the necessary mechanical strength by reducing the outer diameter of the conductors can be assured and the possibility of disconnection due to the tensile load and bending at terminal solderless contact can be reduced. Accordingly, the thus produced high-tensile copper alloy for the current conduction and having superior flexibility according to the present invention is suitably used as the conductors for wiring in an electronic device, lead wire materials for semiconductor devices, and the like.

As being apparent from the foregoing, in the case where the high-tensile copper alloy for the current conduction and having superior flexibility according to the present invention is used, for example, as conductors for car electric wires, the car electric wires are reduced in weight because the copper alloy has high strength against mechanical shocks, has high conductivity in electric characteristics, and allows to make the conductors small-sized.

The method for producing the high-tensile copper alloy for the current conduction having superior flexibility according to the present invention is not particularly limited and any conventional method for producing copper alloys may be employed.

The present invention will be described in more detail by referring to the following examples thereof and the comparative examples, but the present invention is not construed as being limited to the examples.

EXAMPLES 1-1 TO 1-5 AND COMPARATIVE EXAMPLES 1-1 TO 1-5

As examples of the first embodiment of the present invention, copper coated with graphite particles was melted in a melting furnace in which an inert gas atmosphere was maintained; Ni, In and Sn in the form of pure metal and Si in the form of a hardener were added in various composition ratios to the molten copper to thereby obtain various uniform molten alloys; and then the molten alloys each was continuously cast to thereby prepare cast bars each having a diameter of 20 mm and respectively having compositions as shown in Table 1 below. After cold-rolled to extend so as to have a diameter of 3.2 mm, each of the bars was held while being heated in the inert gas atmosphere at about 90° C. for one hour, and then water-cooled so as to be subjected to a solution treatment. Thereafter, each bar is extended so as to have a diameter of 1.0 mm, and further subjected to annealing treatment in the inert gas atmosphere at about 470° C. for six hours to prepare wires according to the present invention.

Measurement was performed on the wires with respect to the tensile strength, elongation, conductivity, and repetition bending strength.

The wires for the comparative examples were prepared and measured in the same manner as the examples of the present invention. Additionally, conventional hard copper and annealed copper as the control were subjected to the same measurement.

Figure 1C:
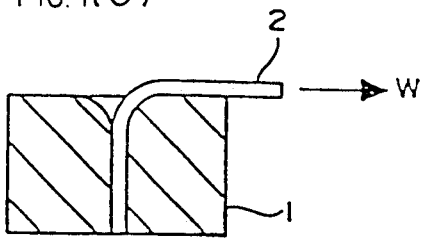
Figure 1D:
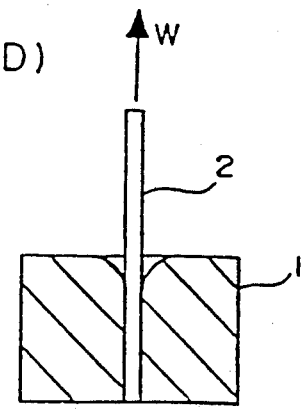
Figure 1B:
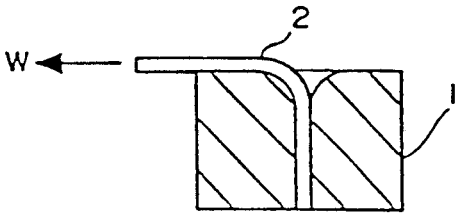

In the bending test, as shown in FIG. 1, one end of a specimen 2 was sandwiched by a jig 1, and the specimen 2 was bent left and right at 90 degrees under the condition that a tension load W of 2 kg was applied to the other end of the specimen 2, through the steps (A), (B), (C) and (D) successively in FIG. 1. The bending was repeated until the sample material 2 was broken. The number of times of the repetition was regarded as the repetition bending strength.

Table 1 shows compositions and characteristic values of the examples of the present invention together with those of the comparative examples and conventional materials, in order to clarify the features of the high-tensile alloy for current conduction and having superior flexibility according to the present invention.

Although alloys of Comparative Examples 1-4 and 1-5 were produced by using the same kind of components, i.e., Cu, Ni, Si, In, and Sn, as in the examples of the present invention, those alloys of Comparative Examples 1-4 and 1-5 were different in the content of the components from the examples of the present invention.

TABLE 1

| | Composition (% by weight) | | | | | | | Conductivity | Tensile strength | Elongation | Repetition bending strength |
|---|---|---|---|---|---|---|---|---|---|---|---|
| | Ni | Si | In | Sn | Ti | Mg | Cu | (% IACS) | (kg/mm²) | (%) | (number of times) |
| Example 1-1 | 2.23 | 0.46 | 0.23 | 0.14 | — | — | balance | 47 | 83 | 6.3 | 46 |
| Example 1-2 | 2.60 | 0.55 | 0.16 | 0.23 | — | — | balance | 46 | 85 | 5.3 | 45 |
| Example 1-3 | 2.95 | 0.57 | 0.20 | 0.21 | — | — | balance | 45 | 86 | 7.5 | 51 |
| Example 1-4 | 3.42 | 0.70 | 0.15 | 0.09 | — | — | balance | 45 | 84 | 6.1 | 47 |
| Example 1-5 | 3.97 | 0.78 | 0.07 | 0.11 | — | — | balance | 43 | 85 | 4.5 | 43 |
| Comparative Example 1-1 | 3.11 | 0.65 | — | — | — | — | balance | 50 | 63 | 8.0 | 52 |
| Comparative Example 1-2 | 2.55 | 0.61 | — | 3.03 | — | — | balance | 32 | 78 | 7.8 | 49 |
| Comparative Example 1-3 | 2.05 | — | — | — | 1.13 | 0.18 | balance | 45 | 70 | 4.3 | 40 |
| Comparative Example 1-4 | 4.83 | 0.90 | 0.15 | 0.28 | — | — | balance | 38 | 84 | 5.5 | 45 |
| Comparative Example 1-5 | 1.59 | 0.35 | 0.30 | 0.28 | — | — | balance | 43 | 75 | 4.8 | 41 |
| Conventional hard copper | — | — | — | — | — | — | 100 | 98.3 | 49.8 | 0.9 | 19 |
| Conventional annealed copper | — | — | — | — | — | — | 100 | 100.3 | 23.3 | 27.4 | 41 |

As being apparent from the comparison between Example 1—1 through 1-5 and Comparative Example 1—1 through 1-5 in Table 1, it is possible, according to the present invention, to improve the tensile strength without largely lowering the conductivity by making an Ni-Si intermetallic compound precipitate into a copper matrix.

Further, according to the first embodiment of the present invention, In and Sn exist in the form of solid solution in a Cu matrix, and therefore the tensile strength can be further improved, although the conductivity is lowered to a some extent by the presence of solid solutions of In and Sn in the Cu matrix. Although the conductivity is lowered to some extent by the use of alloy elements In and Sn in comparison to that of Comparative Example 1-1, the conductivity of about 46% IACS can be ensured, the repetition bending strength is superior to that of annealed copper, and the tensile strength can be improved more especially than that of hard copper.

Thus, the high-tensile copper alloy for current conduction and superior in flexibility according to the first embodiment of the present invention has extremely superior tensile strength which is not less than about 1.7 times of that of hard copper. Although the conductivity is lowered to some extent, the conductivity can be prevented from lowering to the utmost so as to be about 46% IACS by making a part of elements precipitate.

Further, according to the first embodiment of the present invention, although the elongation becomes less than that of annealed copper, the high-tensile alloy has the elongation not less than five times of that of hard copper, and it is possible to obtain the repetition bending strength superior to that of the annealed copper which is extremely good in repetition bending strength.

EXAMPLES 2-1 TO 2-5 AND COMPARATIVE EXAMPLES 2-1 TO 2-5

As examples of the second embodiment of the present invention, copper coated with graphite particles was melted in a melting furnace in which an inert gas atmosphere was maintained; Ni and In in the form of pure metal, and Co and Si in the form of a hardener were added in various composition ratios to the molten copper to thereby obtain various uniform molten alloys; and then the molten alloys each was continuously cast to thereby prepare cast bars each having a diameter of 20 mm and respectively having compositions as shown in Table 2 below.

The cast bars were processed to prepare wires according to the present invention and measured in the same manner as in Examples 1-1 to 1-5. The wires for the comparative examples and the control were prepared and measured in the same manner as in Example 1-1 to 1-5.

Table 2 shows compositions and characteristic values of the examples of the present invention together with those of the comparative examples and conventional materials, in order to clarify the features of the high-tensile alloy for current conduction and having superior flexibility according to the present invention.

Although alloys of Comparative Examples 2-4 and 2-5 were produced by using the same kind of components, i.e., Cu, Ni, Si, In, and Co, as in the examples of the present invention, those alloys of Comparative Examples 2-4 and 2-5 were different in the content of the components from the examples of the present invention.

TABLE 2

| | Composition (% by weight) | | | | | | | | Conductivity | Tensile strength | Elongation | Repetition bending strength |
|---|---|---|---|---|---|---|---|---|---|---|---|---|
| | Ni | Si | In | Co | Mg | Sn | Ti | Cu | (% IACS) | (kg/mm²) | (%) | (number of times) |
| Example 2-1 | 2.94 | 0.58 | 0.20 | 0.07 | — | — | — | balance | 46 | 86 | 7.4 | 44 |
| Example 2-2 | 3.51 | 0.88 | 0.11 | 0.16 | — | — | — | balance | 44 | 85 | 6.9 | 43 |
| Example 2-3 | 2.70 | 0.57 | 0.09 | 0.13 | — | — | — | balance | 44 | 85 | 6.5 | 43 |
| Example 2-4 | 3.83 | 0.91 | 0.25 | 0.03 | — | — | — | balance | 43 | 87 | 5.8 | 42 |

TABLE 2-continued

| | Composition (% by weight) | | | | | | | | Conductivity | Tensile strength | Elongation | Repetition bending strength |
|---|---|---|---|---|---|---|---|---|---|---|---|---|
| | Ni | Si | In | Co | Mg | Sn | Ti | Cu | (% IACS) | (kg/mm²) | (%) | (number of times) |
| Example 2-5 | 2.25 | 0.17 | 0.17 | 0.16 | — | — | — | balance | 44 | 84 | 6.1 | 43 |
| Comparative Example 2-1 | 3.11 | 0.65 | — | — | — | — | — | balance | 50 | 63 | 8.0 | 52 |
| Comparative Example 2-2 | 2.55 | 0.61 | — | — | — | 3.03 | — | balance | 32 | 78 | 7.8 | 49 |
| Comparative Example 2-3 | 2.05 | — | — | — | 0.18 | — | 1.13 | balance | 45 | 70 | 4.3 | 40 |
| Comparative Example 2-4 | 1.05 | 0.42 | 0.10 | 0.15 | — | — | — | balance | 45 | 73 | 4.9 | 40 |
| Comparative Example 2-5 | 4.23 | 0.11 | 0.23 | 0.05 | — | — | — | balance | 40 | 84 | 5.5 | 45 |
| Conventional hard copper | — | — | — | — | — | — | — | 100 | 98.3 | 49.8 | 0.9 | 19 |
| Conventional annealed copper | — | — | — | — | — | — | — | 100 | 100.3 | 23.3 | 27.4 | 41 |

As being apparent from the comparison between Examples 2-1 through 2-5 and Comparative Examples 2-1 through 2-5 in Table 2, it is possible, according to the present invention, to improve the tensile strength without largely lowering the conductivity by making an Ni-Si intermetallic compound precipitate into a copper matrix.

Further, according to the second embodiment of the present invention, In and Co exist in the form of solid solution in a Cu matrix, and therefore the tensile strength can be further improved, although the conductivity is lowered to a some extent by the presence of solid solutions of In and Co in the Cu matrix. Although the conductivity is lowered to some extent by the use of alloy elements In and Co in comparison to that of Comparative Example 2-1, the conductivity of about 45% IACS can be ensured, the repetition bending strength is superior to that of annealed copper, and the tensile strength can be improved more especially than that of hard copper.

Thus, the high-tensile copper alloy for current conduction and superior in flexibility according to the second embodiment of the present invention has extremely superior tensile strength which is not less than about 1.7 times of that of hard copper. Although the conductivity is lowered to some extent, the conductivity can be prevented from lowering to the utmost so as to be about 45% IACS by making a part of elements precipitate.

Further, according to the second embodiment of the present invention, although the elongation becomes less than that of annealed copper, the high-tensile alloy has the elongation not less than five times of that of hard copper, and it is possible to obtain the repetition bending strength superior to that of the annealed copper which is extremely good in repetition bending strength.

EXAMPLES 3-1 TO 3-5 AND COMPARATIVE EXAMPLES 3-1 TO 3-5

As examples of the third embodiment of the present invention, copper coated with graphite particles was melted in a melting furnace in which an inert gas atmosphere was maintained; Ni, In and Mg in the form of pure metal and Si in the form of a hardener were added in various composition ratios to the molten copper to thereby obtain various uniform molten alloys; and then the molten alloys each was continuously cast to thereby prepare cast bars each having a diameter of 20 mm and respectively having compositions as shown in Table 3 below.

The cast bars were processed to prepare wires according to the present invention and measured in the same manner as in Examples 1-1 to 1-5. The wires for the comparative examples and the control were prepared and measured in the same manner as in Example 1-1 to 1-5.

Table 3 shows compositions and characteristic values of the examples of the present invention together with those of the comparative examples and conventional materials, in order to clarify the features of the high-tensile alloy for current conduction and having superior flexibility according to the present invention.

Although alloys of Comparative Examples 3-4 and 3-5 were produced by using the same king of components, i.e., Cu, Ni, Si, In, and Mg, as in the examples of the present invention, those alloys of Comparative Examples 3-4 and 3-5 were different in the content of the components from the examples of the present invention.

TABLE 3

| | Composition (% by weight) | | | | | | | Conductivity | Tensile strength | Elongation | Repetition bending strength |
|---|---|---|---|---|---|---|---|---|---|---|---|
| | Ni | Si | In | Mg | Sn | Ti | Cu | (% IACS) | (kg/mm²) | (%) | (number of times) |
| Example 3-1 | 3.45 | 0.81 | 0.14 | 0.13 | — | — | balance | 43 | 86 | 6.9 | 45 |
| Example 3-2 | 2.96 | 0.56 | 0.18 | 0.05 | — | — | balance | 46 | 87 | 7.9 | 47 |
| Example 3-3 | 2.31 | 0.45 | 0.20 | 0.23 | — | — | balance | 44 | 86 | 6.5 | 45 |
| Example 3-4 | 3.91 | 0.90 | 0.07 | 0.09 | — | — | balance | 44 | 84 | 6.0 | 44 |
| Example 3-5 | 2.61 | 0.55 | 0.15 | 0.21 | — | — | balance | 45 | 85 | 7.2 | 46 |
| Comparative Example 3-1 | 3.11 | 0.65 | — | — | — | — | balance | 50 | 63 | 8.0 | 52 |
| Comparative | 2.55 | 0.61 | — | — | 3.03 | — | balance | 32 | 78 | 7.8 | 49 |

TABLE 3-continued

| | Composition (% by weight) | | | | | | | Conductivity | Tensile strength | Elongation | Repetition bending strength (number of |
|---|---|---|---|---|---|---|---|---|---|---|---|
| | Ni | Si | In | Mg | Sn | Ti | Cu | (% IACS) | (kg/mm²) | (%) | times) |
| Example 3-2 | | | | | | | | | | | |
| Comparative Example 3-3 | 2.05 | — | — | 0.18 | — | 1.13 | balance | 45 | 70 | 4.3 | 40 |
| Comparative Example 3-4 | 1.25 | 0.33 | 0.14 | 0.22 | — | — | balance | 48 | 76 | 5.2 | 42 |
| Comparative Example 3-5 | 4.51 | 0.89 | 0.21 | 0.15 | — | — | balance | 39 | 85 | 5.8 | 44 |
| Conventional hard copper | — | — | — | — | — | — | 100 | 98.3 | 49.8 | 0.9 | 19 |
| Conventional annealed copper | — | — | — | — | — | — | 100 | 100.3 | 23.3 | 27.4 | 41 |

As being apparent from the comparison between Example 3-1 through 3-5 and Comparative example 3-1 through 3-5 in Table 3, it is possible, according to the present invention, to improve the tensile strength without largely lowering the conductivity by making an Ni-Si intermetallic compound precipitate into a copper matrix.

Further, according to the third embodiment of the present invention, In and Mg exist in the form of solid solution in a Cu matrix, and therefore the tensile strength can be further improved, although the conductivity is lowered to a some extent by the presence of solid solutions of In and Mg in the Cu matrix. Although the conductivity is lowered to some extent by the use of alloy elements In and Mg in comparison to that of Comparative Example 3-1, the conductivity of about 45% IACS can be ensured, the repetition bending strength is superior to that of annealed copper, and the tensile strength can be improved more especially than that of hard copper.

Thus, the high-tensile copper alloy for current conduction and superior in flexibility according to the third embodiment of the present invention has extremely superior tensile strength which is not less than about 1.7 times of that of hard copper. Although the conductivity is lowered to some extent, the conductivity can be prevented from lowering to the utmost so as to be about 45% IACS by making a part of elements precipitate.

Further, according to the third embodiment of the present invention, although the elongation becomes less than that of annealed copper, the high-tensile alloy has the elongation not less than five times of that of hard copper, and it is possible to obtain the repetition bending strength superior to that of the annealed copper which is extremely good in repetition bending strength.

EXAMPLES 4-1 TO 4-5 AND COMPARATIVE EXAMPLES 4-1 TO 4-5

As examples of the fourth embodiment of the present invention, copper coated with graphite particles was melted in a melting furnace in which an inert gas atmosphere was maintained; Ni, In, Sn and Mg in the form of pure metal and Si in the form of a hardener alloy were added in various composition ratios to the molten copper to thereby obtain various uniform molten alloys; and then the molten alloys each was continuously cast to thereby prepare cast bars each having a diameter of 20 mm and respectively having compositions as shown in Table 1 below.

The cast bars were processed to prepare wires according to the present invention and measured in the same manner as in Examples 1—1 to 1-5. The wires for the comparative examples and the control were prepared and measured in the same manner as in Example 1—1 to 1-5.

Table 4 shows compositions and characteristic values of the examples of the present invention together with those of the comparative examples and conventional materials, in order to clarify the features of the high-tensile alloy for current conduction and having superior flexibility according to the present invention.

Although alloys of Comparative Example 4—4 through 4-6 were produced by using the same king of components, i.e., Cu, Ni, Si, In, and Mg, as in the examples of the present invention, those alloys of Comparative Examples 4-4 through 4-6 were different in the content of the components from the examples of the present invention.

TABLE 4

| | Composition (% by weight) | | | | | | | Conductivity | Tensile strength | Elongation | Repetition bending strength (number of |
|---|---|---|---|---|---|---|---|---|---|---|---|
| | Ni | Si | In | Sn | Mg | Ti | Cu | (% IACS) | (kg/mm²) | (%) | times) |
| Example 4-1 | 2.33 | 0.48 | 0.15 | 0.22 | 0.09 | — | balance | 45 | 82 | 7.2 | 44 |
| Example 4-2 | 2.65 | 0.54 | 0.21 | 0.20 | 0.13 | — | balance | 43 | 84 | 7.4 | 46 |
| Example 4-3 | 3.02 | 0.63 | 0.23 | 0.07 | 0.16 | — | balance | 44 | 85 | 6.8 | 45 |
| Example 4-4 | 3.46 | 0.70 | 0.12 | 0.19 | 0.07 | — | balance | 42 | 84 | 6.5 | 43 |
| Example 4-5 | 3.78 | 0.76 | 0.08 | 0.13 | 0.18 | — | balance | 42 | 85 | 6.3 | 43 |
| Comparative Example 4-1 | 3.11 | 0.65 | — | — | — | — | balance | 50 | 63 | 8.0 | 52 |
| Comparative Example 4-2 | 2.55 | 0.61 | — | 3.03 | — | — | balance | 32 | 78 | 7.8 | 49 |
| Comparative Example 4-3 | 2.05 | — | — | — | 0.18 | 1.13 | balance | 45 | 70 | 4.3 | 40 |
| Comparative | 1.33 | 0.40 | 0.12 | 0.19 | 0.08 | — | balance | 44 | 71 | 5.1 | 41 |

TABLE 4-continued

| | Composition (% by weight) | | | | | | | Conductivity (% IACS) | Tensile strength (kg/mm²) | Elongation (%) | Repetition bending strength (number of times) |
|---|---|---|---|---|---|---|---|---|---|---|---|
| | Ni | Si | In | Sn | Mg | Ti | Cu | | | | |
| Example 4-4 | | | | | | | | | | | |
| Comparative Example 4-5 | 3.10 | 0.63 | 0.03 | 0.02 | 0.10 | — | balance | 46 | 75 | 5.8 | 48 |
| Conventional Example 4-6 | 4.37 | 0.12 | 0.21 | 0.14 | 0.15 | — | balance | 37 | 84 | 5.3 | 40 |
| Conventional hard copper | — | — | — | — | — | — | 100 | 98.3 | 49.8 | 0.9 | 19 |
| Conventional annealed copper | — | — | — | — | — | — | 100 | 100.3 | 23.3 | 27.4 | 41 |

As being apparent from the comparison between Examples 4-1 through 4-5 and Comparative Examples 4-1 through 4-6 in Table 4, it is possible, according to the present invention, to improve the tensile strength without largely lowering the conductivity by making an Ni-Si intermetallic compound precipitate into a copper matrix.

Further, according to the fourth embodiment of the present invention, In and Sn exist in the form of solid solution in a Cu matrix, and therefore the tensile strength can be further improved, although the conductivity is lowered to a some extent by the presence of solid solutions of In and Mg in the Cu matrix. By further adding Mg, the tensile strength can be improved without adversely affecting the conductivity since Mg partly forms an intermetallic compound with Si. Although the conductivity is lowered to some extent by the use of alloy elements In and Sn in comparison to that of Comparative Example 4-1, the conductivity of about 42% IACS can be ensured, the repetition bending strength is superior to that of annealed copper, and the tensile strength can be improved more especially than that of hard copper.

Thus, the high-tensile copper alloy for current conduction and superior in flexibility according to the fourth embodiment of the present invention has extremely superior tensile strength which is not less than about 1.6 times of that of hard copper. Although the conductivity is lowered to some extent, the conductivity can be prevented from lowering to the utmost so as to be about 42% IACS by making a part of elements precipitate.

Further, according to the fourth embodiment of the present invention, although the elongation becomes less than that of annealed copper, the high-tensile alloy has the elongation not less than seven times of that of hard copper, and it is possible to obtain the repetition bending strength superior to that of the annealed copper which is extremely good in repetition bending strength.

EXAMPLES 5-1 TO 5—5 AND COMPARATIVE EXAMPLES 5-1 TO 5—5

As examples of the fifth embodiment of the present invention, copper coated with graphite particles was melted in a melting furnace in which an inert gas atmosphere was maintained; Ni, In and Mg in the form of pure metal, and co and Si in the form of a hardener were added in various composition ratios to the molten copper to thereby obtain various uniform molten alloys; and then the molten alloys each was continuously cast to thereby prepare cast bars each having a diameter of 20 mm and respectively having compositions as shown in Table 5 below.

The cast bars were processed to prepare wires according to the present invention and measured in the same manner as in Examples 1—1 to 1-5. The wires for the comparative example and the control were prepared and measured in the same manner as in Example 1—1 to 1-5.

Table 5 shows compositions and characteristic values of the examples of the present invention together with those of the comparative examples and conventional materials, in order to clarify the features of the high-tensile alloy for current conduction and having superior flexibility according to the present invention.

Although alloys of Comparative Examples 5-4 through 5-6 were produced by using the same king of components, i.e., Cu, Ni, Si, In, Co and Mg, as in the examples of the present invention, those alloys of Comparative Examples 5-4 through 5-6 were different in the content of the components from the examples of the present invention.

TABLE 5

| | Composition (% by weight) | | | | | | | | Conductivity (% IACS) | Tensile strength (kg/mm²) | Elongation (%) | Repetition bending strength (number of times) |
|---|---|---|---|---|---|---|---|---|---|---|---|---|
| | Ni | Si | In | Co | Mg | Ti | Sn | Cu | | | | |
| Example 5-1 | 2.33 | 0.42 | 0.07 | 0.12 | 0.15 | — | — | balance | 45 | 85 | 6.9 | 46 |
| Example 5-2 | 2.58 | 0.53 | 0.22 | 0.07 | 0.08 | — | — | balance | 42 | 86 | 5.5 | 43 |
| Example 5-3 | 2.97 | 0.59 | 0.09 | 0.09 | 0.18 | — | — | balance | 43 | 85 | 6.7 | 43 |
| Example 5-4 | 2.36 | 0.67 | 0.13 | 0.15 | 0.10 | — | — | balance | 41 | 86 | 5.2 | 44 |
| Example 5-5 | 3.76 | 0.82 | 0.16 | 0.11 | 0.08 | — | — | balance | 41 | 87 | 6.3 | 45 |
| Comparative Example 5-1 | 3.11 | 0.65 | — | — | — | — | — | balance | 50 | 63 | 8.0 | 52 |
| Comparative Example 5-2 | 2.55 | 0.61 | — | — | — | — | 0.03 | balance | 32 | 78 | 7.8 | 49 |
| Comparative Example 5-3 | 2.05 | — | — | — | 0.18 | 1.13 | — | balance | 45 | 70 | 4.3 | 40 |
| Comparative Example 5-4 | 1.25 | 0.23 | 0.18 | 0.08 | 0.12 | — | — | balance | 45 | 70 | 4.9 | 43 |

TABLE 5-continued

| | Composition (% by weight) | | | | | | | | Conductivity (% IACS) | Tensile strength (kg/mm²) | Elongation (%) | Repetition bending strength (number of times) |
|---|---|---|---|---|---|---|---|---|---|---|---|---|
| | Ni | Si | In | Co | Mg | Ti | Sn | Cu | | | | |
| Comparative Example 5-5 | 2.76 | 0.58 | 0.03 | 0.12 | 0.05 | — | — | balance | 42 | 75 | 5.6 | 43 |
| Comparative Example 5-6 | 4.43 | 0.55 | 0.15 | 0.13 | 0.11 | — | — | balance | 39 | 85 | 4.8 | 40 |
| Conventional hard copper | — | — | — | — | — | — | 100 | | 98.3 | 49.8 | 0.9 | 19 |
| Conventional annealed copper | — | — | — | — | — | — | 100 | | 100.3 | 23.3 | 27.4 | 41 |

As being apparent from the comparison between Examples 5-1 through 5-5 and Comparative examples 5-1 through 5-6 in Table 5, it is possible, according to the present invention, to improve the tensile strength without largely lowering the conductivity by making an Ni-Si intermetallic compound precipitate into a copper matrix.

Further, according to the fifth embodiment of the present invention, In and Co exist in the form of solid solution in a Cu matrix, and therefore the tensile strength can be further improved, although the conductivity is lowered to a some extent by the presence of solid solutions of In and Co in the Cu matrix. By further adding Mg, the tensile strength can be improved without adversely affecting the conductivity since Mg partly forms an intermetallic compound with Si. Although the conductivity is lowered to some extent by the use of alloy elements In and Co in comparison to that of Comparative Example 5-1, the conductivity of about 41% IACS can be ensured, the repetition bending strength is superior to that of annealed copper, and the tensile strength can be improved more especially than that of hard copper.

Thus, the high-tensile copper alloy for current conduction and superior in flexibility according to the fifth embodiment of the present invention has extremely superior tensile strength which is not less than about 1.7 times of that of hard copper. Although the conductivity is lowered to some extent, the conductivity can be prevented from lowering to the utmost so as to be about 41% IACS by making a part of elements precipitate.

Further, according to the fifth embodiment of the present invention, although the elongation becomes less than that of annealed copper, the high-tensile alloy has the elongation not less than five times of that of hard copper, and it is possible to obtain the repetition bending strength superior to that of the annealed copper which is extremely good in repetition bending strength.

As described above, according to the present invention, in comparison with hard copper, the conductive high-tensile copper alloy has the especially superior tensile strength which is not less than about from 1.6 to 1.7 times of that of the hard copper, and although the conductivity is lowered to some extent, the conductivity can be greatly prevented from lowering to thereby assure about from 41 to 46% IACS by making a part of additive elements precipitate.

Further, according to the present invention, although the elongation is smaller than that of the annealed copper, the elongation is more than five to seven times of the hard copper, and it is possible to obtain the repetition bending strength superior to that of the annealed copper which is extremely good in repetition bend strength.

According to the present invention, therefore, it is possible to obtain the features which are suitable as conductors for car electric wires, so that the necessary mechanical strength for miniaturization in outer diameter of the conductors can be assured, and disconnection due to the tensile load and the bending at terminal solderless contact portions can be reduced.

Further, according to the present invention, the high-tensile copper alloy for current conduction is preferable for use as conductors of electric wires for wiring in an electronic appliance, lead wire materials for semiconductor devices, and the like.

While the invention has been described in detail and with reference to specific examples thereof, it will be apparent to one skilled in the art that various changes and modifications can be made without departing from the spirit and scope thereof.

What is claimed is:

1. A high-tensile copper alloy for current conduction consisting essentially of: from 2.0 to 4.0% by weight of Ni; from 0.4 to 1.0% by weight of Si; from 0.05 to 0.3% by weight of In; from 0.05 to 0.3% by weight of Sn; and the balance of Cu.

2. A high-tensile copper alloy for current conduction as claimed in claim 1, wherein the weight ratio of Ni to Si is from 4 to 5.

* * * * *